United States Patent [19]

Corba

[11] Patent Number: 4,993,214

[45] Date of Patent: Feb. 19, 1991

[54] METHOD OF ASSEMBLING A TRIGGER SPRAYER DEVICE

[75] Inventor: Robert E. Corba, Racine County, Wis.

[73] Assignee: S. C. Johnson & Son, Inc., Racine, Wis.

[21] Appl. No.: 419,932

[22] Filed: Oct. 11, 1989

Related U.S. Application Data

[62] Division of Ser. No. 165,220, Mar. 8, 1988, abandoned.

[51] Int. Cl.[5] ..... B65B 7/28

[52] U.S. Cl. ..... 53/471; 53/485; 29/888.02

[58] Field of Search ..... 29/888.02; 53/410, 413, 53/420, 421, 467, 470, 471, 476, 484, 485, 488

[56] References Cited

U.S. PATENT DOCUMENTS

| | | |
|---|---|---|
| 3,061,202 | 10/1962 | Tyler . |
| 3,172,582 | 3/1965 | Belpedio . |
| 3,478,935 | 11/1969 | Brooks . |
| 3,701,478 | 10/1972 | Tada . |
| 3,840,157 | 10/1974 | Hellenkamp . |
| 3,927,834 | 12/1975 | Tada . |
| 3,940,028 | 2/1976 | Beard . |
| 4,072,252 | 2/1978 | Steyns et al. . |
| 4,077,548 | 3/1978 | Beard . |
| 4,077,549 | 3/1978 | Beard . |
| 4,082,223 | 4/1978 | Nozawa . |
| 4,120,430 | 10/1978 | French . |
| 4,157,774 | 6/1979 | Micallef . |
| 4,159,067 | 6/1979 | Akers . |
| 4,186,855 | 2/1980 | Edman et al. . |
| 4,352,443 | 10/1982 | Libit . |
| 4,436,225 | 3/1984 | Libit . |
| 4,449,647 | 5/1984 | Reed et al. . |
| 4,452,379 | 6/1984 | Bundschuh . |
| 4,479,593 | 10/1984 | Bundschuh . |
| 4,506,805 | 3/1985 | Marcon . |
| 4,558,821 | 12/1986 | Tada . |
| 4,591,076 | 5/1986 | Iizuka . |
| 4,643,338 | 2/1987 | Iizuka . |

OTHER PUBLICATIONS

Bottom and side perspective photographs of Continental Sprayers, Inc. trigger sprayer marked "Mfg. Under License from T. Tada".

International Search Report, Patent Convention Treaty Application No. PCT/U.S. 89/00845, May 26, 1989, 3 pages.

*Primary Examiner*—Robert L. Spruill

*Assistant Examiner*—Linda B. Johnson

[57] ABSTRACT

A method of assembling a trigger sprayer which includes a container for holding a product, a pump module for pumping the product and a pump actuating module for actuating the pump. The method comprises adding the product to the container, placing the pump module into the container, and relatively advancing the pump actuating module and the container holding the pump module so that locking means locks the three components together and mating means join complementary portions of the pump module and the pump actuation module together.

4 Claims, 4 Drawing Sheets

METHOD OF ASSEMBLING A TRIGGER SPRAYER DEVICE

This is a continuation of co-pending application serial no. 07/165,220 filed on Mar. 8, 1988, now abandoned.

BACKGROUND OF THE INVENTION

1. Field of the Invention

The present invention relates generally to trigger actuated sprayers for dispensing liquid from a container, particularly to the trigger assembly for such a sprayer, and to methods for assembling a complete device.

2. Description of the Related Art

Trigger actuated sprayers which dispense liquids in response to depression of a trigger are well known. The sprayers have received wide consumer acceptance and appeal due to the ease of handling the sprayer, the efficiency with which the sprayer dispenses liquid, and the convenience of using such a sprayer. Typically, the sprayers are used to dispense a variety of liquid products, such as cleaning solutions, cosmetics, toiletries, agricultural and industrial products.

Such trigger sprayers have a nozzle for dispensing either a spray or a stream of the liquid products. As part of the design of the s prayer, the aim point of the nozzle must be kept relatively constant as the trigger handle is depressed. Generally, three alternatives are available to ensure that the aim point does not substantially change. The alternatives are illustrated schematically in FIGS. 1, 2 and 3.

First, as illustrated din FIG. 1, nozzle 101 may be fixed onto the trigger sprayer body so that it does not move as trigger handle 102 is operated. The trigger handle in a device using this alternative compresses a separate pump 103 in the direction off the arrow. An unshown passage communicating with the nozzle leads the liquid from the pump to the nozzle. U.S. Pat. No. 3,061,202 to Tyler illustrates a trigger sprayer using a fixed nozzle and a separate pump.

The second alternative to ensure that the aim point of the nozzle is kept relatively constant is illustrated in FIG. 2. In this alternative, nozzle 101 is formed integrally with pump 103. The nozzle is formed so that the aim point coincides with the pumping axis of the pump. Thus, as trigger handle 102 is depressed to operate the pump, the nozzle moves back along the pumping axis, in the direction of the arrow, thereby maintaining a constant aim point. U.S. Pat. No. 3,701,478 to Tada illustrates a trigger sprayer in which the nozzle moves back along the pumping axis as the trigger handle is depressed.

The third alternative to keep the aim point of the nozzle relatively constant is to mount the nozzle at the end of the pump and to aim the nozzle at an angle relative to the pumping axis. As shown in FIG. 3, nozzle 101 is mounted at a right angle relative to pump 103. As trigger handle 102 is operated, the pump is depressed and the nozzle moves down in the direction of the arrow with the pump. Although the aim point of the nozzle in this alternative moves slightly in the vertical direction, for all practical purposes the aim point is constant. U.S. Pat. N o. 4,077,549 to Beard illustrates a trigger sprayer in which the nozzle descends as the trigger handle is depressed.

In all these designs, however, when the trigger handle is depressed, the radial distance between the pivot point for the handle 106 and the depression point of the handle (between cam 105 and sliding surface 104) changes. This is shown schematically in FIG. 4*a*. When the trigqer handle is in a depressed position, indicated by the solid lines, the radial distance L1 between the pivot point P of the trigqer handle and the depression point D of the trigger handle is different than the radial distance when the trigger handle is released. The released position is indicated by the dotted lines in FIG. 4*a*. As depicted in FIG. 4*a*, the released distance L2 is considerably less than the depressed distance L1. Thus, to allow the aim point of the nozzle to remain constant while the trigger handle is depressed, a special structure must be utilized to accommodate this change in radial distance.

Although a variety of special structures have been adapted to accommodate the change in radial distance, the usual structure consists of a cam and a sliding surface which allows the trigger handle to pivot about its pivot point while maintaining the nozzle (or the pump in the FIG. 1 alternative) in its desired orientation. A cam and a sliding surface are denoted by numerals 105 and 104, respectively, in FIGS. 1, 2 and 3. By way of further example, a cam and a sliding surface may be seen in FIG. 3, reference numerals 40 and 41 in Tyler; FIG. 2, reference numerals 54 and 55 in Tada; and FIG. 1, reference numerals 17 and 26 in Beard.

Another structure for accommodating the change in radial distance is illustrated in U.S. Pat. No. 4,077,548 to Beard, which utilizes a complicated series of pivot points and levers, as shown in FIG. 5 therein.

However, the designs for such structures are involved and require extremely close tolerances to operate properly. The structures are complicated and have a high parts count. Often, the structures are fragile, due to small parts being subjected to high stress. Moreover, since the trigqer handle is usually supported at only one pivot point, both the pivot point and the trigger handle are highly susceptible to damage.

Since the parts count is high, it is extremely difficult inexpensively to manufacture the device and to assemble a finished product. Close tolerances of many of the parts also cause assembly of the trigger sprayer to be extremely difficult, costly and time consuming. The insertion of the trigqer pivot point into its pivot assembly and the alignment of the trigqer handle with the pump are particularly difficult operations.

The high parts count and the need for close tolerances also lead to problems with leakage of the contents of the container when the pump is not being used, or when the container is inverted.

SUMMARY OF THE INVENTION

The present invention is a trigger sprayer designed to overcome the above mentioned disadvantages of conventional trigger sprayers.

More specifically, the present invention is a trigqer sprayer incorporating a special "living" hinge as the pivot point for the trigger handle. The "living" hinge comprises a flexure which may be distorted in response to depression of the trigger handle. The distortion is both an angular distortion to allow the trigger handle to rotate about the pivot point as the trigqer handle is depressed, and a lateral distortion to accommodate the change in radial distance between the pivot point and the depression point (compare FIG. 4*a* with FIG. 4*b*). This flexure provides a moving hinge point for the trigqer handle.

The flexure can be integrally molded with the frame and the trigger handle, thus reducing the number of parts required to construct a trigger sprayer. Accordingly, the complexity and tolerances which must be maintained are significantly reduced, and the device may be constructed with ease.

The present invention addresses the problem of leakage from the trigqer sprayer by positioning the pump assembly of the sprayer completely within the container for the liquid. The pump also incorporates a lip structure which, in terms of a preferred embodiment of the invention, is located at the upper surface of the piston of the pump. This lip dovetails with a complementarily shaped structure in an upper surface of the pump, to form a seal effective to reduce significantly the amount of liquid which leaks from the trigger sprayer when the sprayer is unused or is in an inverted position.

Assembly of the finished product is facilitated by the modular structure of the trigger sprayer. Thus, the pump and the trigqer sprayer may be separately assembled, and even assembled at different locations. The structure of the sprayer reduces the number of parts with critical tolerances and provides for easy interconnection of the disjoint modules. Accordingly, assembly of a finished product may be accomplished by inserting a pump module into a filled container, and snapping a trigger sprayer module over the pump module. The structure of the trigger sprayer quickly accommodates mating connections on the pump module, and the mount on the trigger sprayer module seals both the trigger sprayer module and the pump module to the filled container with a simple thrusting motion, i.e. no rotational motion is required.

A more complete appreciation of the present invention and a more thorough understanding of these and other aspects and features thereof will be obtained by considering the following detailed description in conjunction with the accompanying drawings.

DETAILED DESCRIPTION OF THE PREFERRED EMBODIMENT

Figure 5:
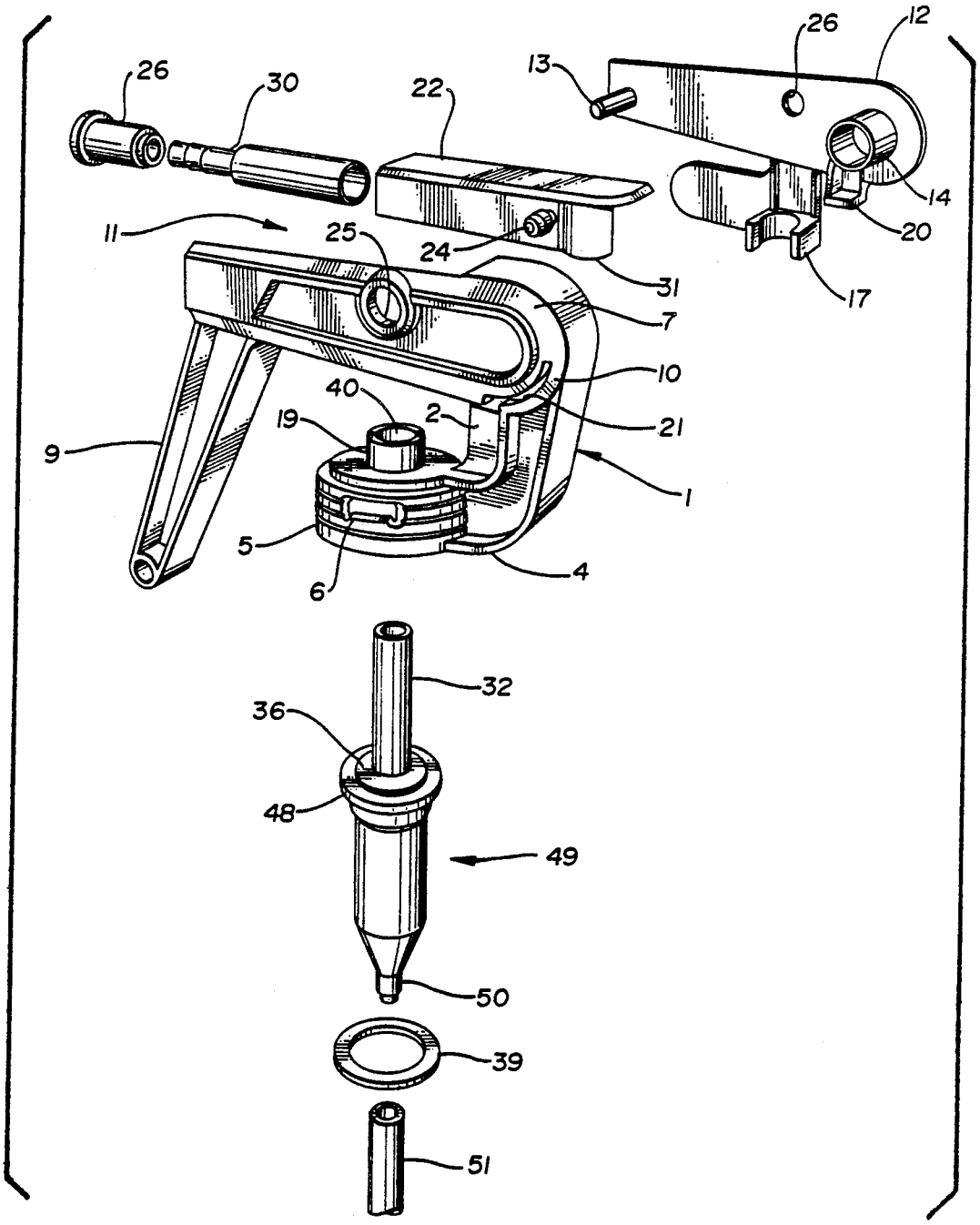
FIG. 5 is an exploded perspective view of an embodiment of the present invention.

Referring to FIG. 5, the device is a modular trigqer sprayer having an integrally molded flexure or "living" hinge. The device has a generally U shaped frame 1. Strengthening rib 2 is formed at the base of the frame to provide additional rigidity for the structure as the device is operated.

Lower leg 4 of the frame merges with cap or baseplate having bayonnet connector 6 for attachment to a bottle or a container (not shown). A screw connector or a snap on connector may also be used.

Upper leg 7 of the frame merges into a dependent trigger handle 9. The handle is angled relative to this leg, and extends in the general direction of cap 5.

Figure 6:
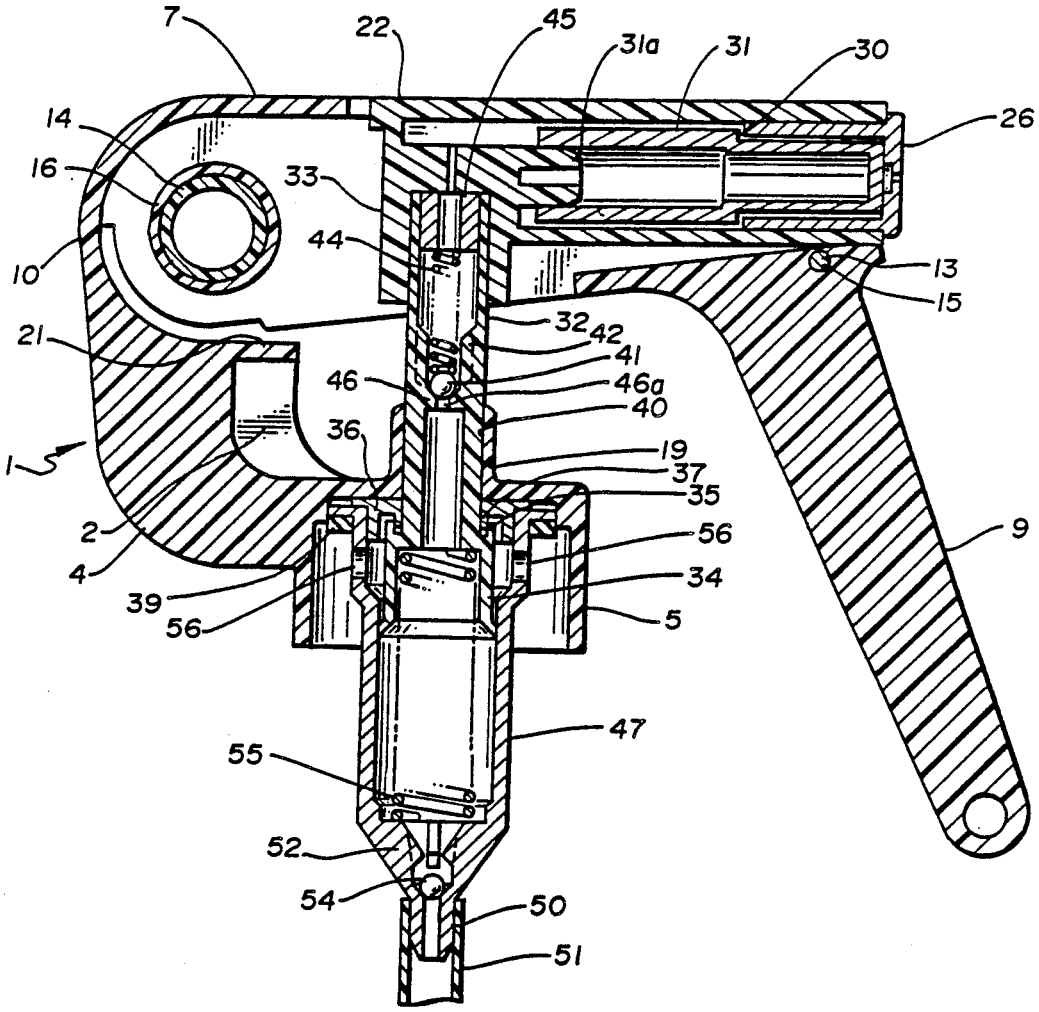
FIG. 6 is a cross sectional- view of the assembled embodiment shown in FIG. 5.

An integral flexure 10, is formed at the base of upper leg 7. As best seen in FIG. 6, the flexure has an arcuate shape which allows it to distort freely both angularly and laterally. The angular distortion allows the trigger handle to rotate about its pivot point, while the lateral distortion allows the upper leg to be displaced laterally by means to be described later. In the preferred embodiment of the invention, the flexure is molded from polypropylene, but any material having sufficient flexibility and strength, such as nylon, may be used. Alternatively, while it is preferred to mold the flexure integrally with the frame, the flexure may be formed from a strip of metal which connects an upper leg molded separately from the remaining frame. Use of a metallic strip having a high spring constant also permits elimination of internal biasing springs within the trigger sprayer, and may be preferred when the trigger sprayer is used to dispense corrosive products.

Because of the plastic memory exhibited by all these materials, the materials also provide a return force to return the trigger sprayer to its quiescent state after the trigger handle has been depressed and released. The flexibility, distortability and plastic memory are all functions of the material used and the dimensions of the flexure. In the preferred embodiment, the flexure is approximately 0.4 inches wide by 0.1 inches thick by 0.3 inches long (measured along the arc of the flexure). Other combinations are, of course, possible. However, the thickness is preferably in the range 0.05 and 0.20 inches; outside this range, the flexure is either too fragile, or the trigger sprayer is too hard to operate. Similarly, the length should be in the range 0.10 to 0.50 inches, for the same reasons. The width of the flexure should be sufficient fully to accommodate delivery arm 22, to be described later.

Upper leg 7 also includes channel 11, the third side of which channel is formed by side member 12. Side member 12 is attached to the upper leg of the frame by press fit of pins 13 and 14 within holes 15 and 16, respectively. (See FIG. 6.)

Side member 12 also includes a frangible locking lever 17, which is rotatable about an axis formed by the lower edge of the side member. The locking lever may be press-engaged around neck 19 of cap 5 to prevent undesired actuation of the device. If desired, the locking lever can be designed solely to prevent actuation during shipment, and can be completely removed prior to use.

Pawl 20 is also mounted on side member 12 and engages projection 21 to limit the extent of upward travel of upper leg 7. The engagement of pawl 20 with projection 21 also serves to prevent damage to the sprayer if it is lifted by trigger handle 9.

Delivery arm 22 is mounted for rotational movement within channel 11 by mutual engagement of pivot pin 24 with pivot hole 25 in the upper leg of the frame and mutual engagement of an unshown pivot pin with pivot hole 26 in side member 12. The pivot points allow delivery arm 22 to rotate with respect to the channel. It should be understood that although pivot points are depicted, a segment of flexible material (plastic, for example) may be utilized to attach delivery arm 22 to upper leg 7 and to provide for rotational movement within channel 11.

Figure 7:
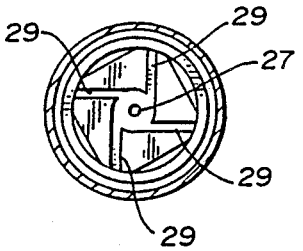
FIG. 7 is cross sectional view of the nozzle assembly for the embodiment shown in FIG. 5.

As shown in FIG. 6, delivery arm 22 is substantially hollow with a rectangular cross section. Nozzle 26 is inserted at a distal end of the delivery arm. Referring to FIG. 7, nozzle 26 has a small hole 27 for expelling liquid in a stream or spray. Within the nozzle and adjacent to the hole, a swirl chamber comprising channels 29 is formed. Swirl plug 30, also enclosed within the delivery arm, is inserted into nozzle 26. The swirl plug channels liquid moving through the delivery arm to the extreme portions of the swirl chamber, to impart angular momentum to the liquid flow. This conditions the flow of liquid prior to being expelled through the hole in the nozzle to allow a more uniform and more precise spray or stream to be formed. Of course, the swirl plug or the nozzle may be made movable to vary the characteristics of the spray or stream, or completely to seal the nozzle.

Swirl plug 30 extends leftwardly as shown in FIG. 6 and widens into insert post 31. The interior of insert post 31 is sealed with locking plug 31*a* to prevent formation of an air cushion which would adversely affect operation of the sprayer.

At the other end of the delivery arm, a short depending tubular section 33 is formed perpendicularly relative to the delivery arm, to accept tubular extension 32. The lower end of tubular extension 32 is flared into an inverted cup shape to form piston 34 for a pump. At the shoulders of the flare, lip 35 is formed in the piston.

Tubular extension 32 is inserted through a hole in ferrule 36 which has a complementarily shaped lip 37 formed on the inside thereof. When the trigger sprayer is in a quiescent, non-operated state, the lip of the piston sealingly engages with the lip in the ferrule. This seal is sufficient to prevent leakage of liquid from the container through the pump when the trigger sprayer is unused or inverted. Gasket 39 prevents leakage of liquid past cap 5.

The upper end of tubular extension 32 is also inserted through an opening 40 in cap 5 and press fit into the depending tubular section of the delivery arm. As shown in FIG. 6, ball 41 is supported within the upper portion of the tubular extension by a series of ribs 42. The ball is urged downwardly by spring 44, which is confined within the tubular extension by cylindrical insert 45. The spring biases the ball against an aperture in seat 46 formed by the series of ribs, to form a valve within the tubular extension.

Figure 8:
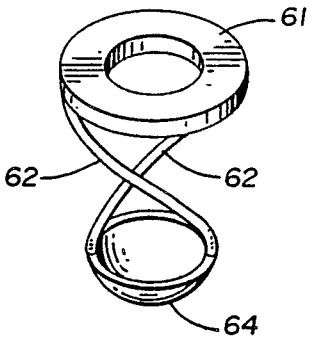
FIG. 8 is a perspective view of a ball valve usable with the invention.

As an alternative to ball 41 and spring 44, the assembly shown in FIG. 8 may instead be utilized. FIG. 8 shows a plastic ball insert molded from a single piece of plastic and designed to be press fit into tubular extension 32. The insert includes a washer shaped upper plate 61 for engagement with the inner surface of the tubular extension. Two plastic helixes 62 extend downwardly from the plate and terminate in a plastic hemisphere 64 having the same diameter as ball 41. The helixes act as a spring and permit hemisphere 64 to move upwardly against a spring bias.

Cylinder 47 of pump 49 is flared at the upper end 48 for tight engagement with the sides of a recess formed in the inside top surface of cap 5, so that the cylinder and the cap are effectively fixed one to the other. The inner diameter of the cylinder is constructed to seat ferrule 36 tightly. The lower end of cylinder 47 tapers gradually to nipple 50 which is adapted frictionally to receive dip tube 51.

The interior of the cylinder closely accepts piston 34. The lower end of the interior of the cylinder is formed with a recess consisting of confining ribs 52 which loosely confine ball 54. These ribs also serve as a seat for compression spring 55 which extends upwardly to the inner surface of piston 34, thus urging the piston in a direction away from the dip tube and causing the lip of the piston to seal with the lip of the ferrule.

In general, the dimensions and tolerances of the various elements in the trigger sprayer, as well as the mating accuracy of adjacent elements, are not overly critical. For example, tubular extension 32 may loosely fit into the hole in ferrule 36. This wide latitude in dimensional accuracy contributes to the low cost and simple manufacture of the sprayer. However, to prevent leaks and pressure blowouts of sprayer elements during operation, it is important to observe dimensional matching between flare 48 of the pump and the mating surface of cap 5, between nozzle insert 26 and the mating surface of delivery arm 22, and between locking plug 31*a* and insert post 31.

In operation, when trigger handle 9 is depressed, upper leg 7 moves downwardly about flexure 10. The delivery arm 22 also moves downwardly, but is caused to pivot about its mounting to maintain a substantially horizontal orientation due to the constraining force exerted by tubular extension 32 inserted through cap 5.

Figure 4A:
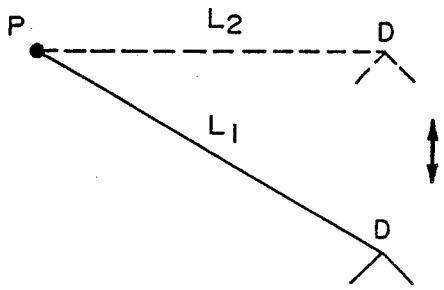
FIG. 4a PRIOR ART
FIG. 4*a* is a diagram illustrating the change in radial distance between the pivot point and the depression point as the trigger handle is depressed.
Figure 4B:
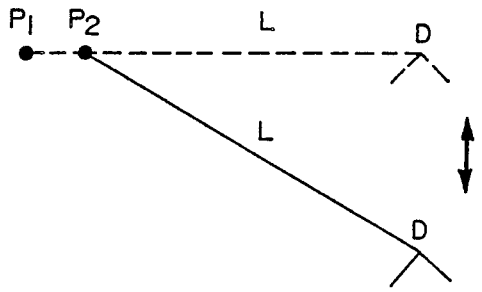
FIG. 4*b* is a diagram illustrating flexure distortion of the present invention.

When the trigger handle is in this depressed condition, the radial distance between the flexure 10 and the pivot point 25–26 of the delivery arm would normally be greater than the radial distance when the trigger handle is in the free position, as shown schematically in FIG. 4*a*. To eliminate this difference in radial distance, the flexure must distort laterally as it rotates angularly. This is shown schematically in FIG. 4*b*. In this figure, the flexure has distorted laterally from pl to P2. This allows the radial distance L to remain constant during depression of the trigger handle, and eliminates the need for the complicated structures conventionally found to accommodate a change in radial distance (FIG. 4*a*). The shape of the flexure, its location and construction allow the lateral and angular distortion to take place freely During the downward excursion of the delivery arm, the tubular extension 32 also moves downwardly lowering the piston 34 in the cylinder 47 against the action of compression spring 55. Air is expelled through the upper ball check 41. Upon release of the trigger, the compression spring, bearing against the inner seat in the cylinder formed by ribs 52, drives the piston, the piston rod, the delivery arm, the upper frame leg and the trigqer handle back to their respective initial positions. As the piston rises, it draws fluid from the container, through dip tube 51, past lower ball 54, and into the cylinder. Ball 54 prevents the return of the fluid to the container, although a flapper valve may be utilized in place of this ball.

A further cycle of the trigger forces the fluid up through the tubular extension, past the upper ball, along the delivery passage way and to the atmosphere through the nozzle and swirl chamber The upper ball prevents the flow of fluid back to the cylinder. Repeated operations produce repeated intermittent discharge of liquid through the nozzle.

Venting of the container takes place from the atmosphere. During the downward excursion of the piston, air from the atmosphere seeps through the clearance between tubular extension 32 and the aperture 40 in cap 5, and occupies the space behind the piston within the cylinder. Subsequently, when the compression spring within the pump drives the piston upwards, the air in the space behind the piston is forced through opposed vent ports 56 (FIG. 6) in the upper periphery of the cylinder and into the container. This air replaces the volume of fluid drawn into the pump, and prevents the container from collapsing.

Figure 9A:
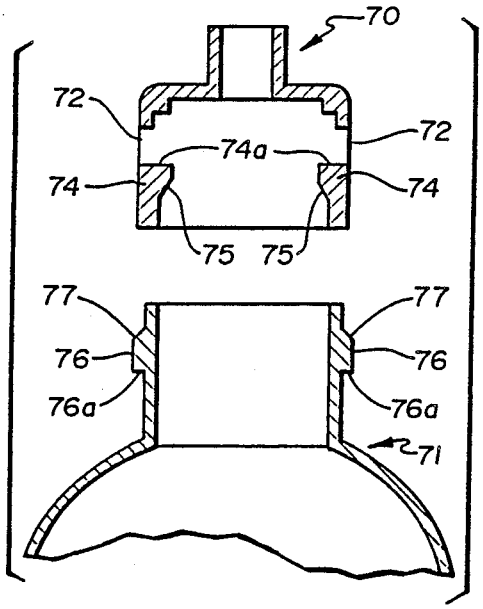
FIGS. 9A and 9B are cross-sectional and plan views, respectively, of a mounting which facilitates assembly of the device.
Figure 9B:
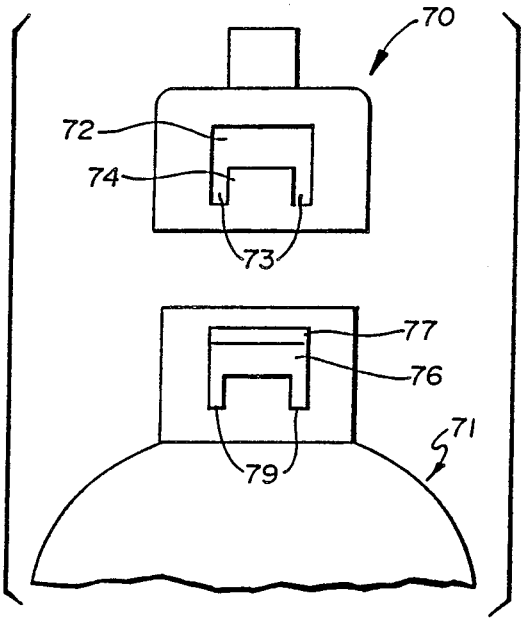

FIGS. 9A and 9B illustrate a mounting arrangement for the trigger sprayer which has been found to be particularly effective. The figures illustrate cap 70 which is much the same as cap 5 shown in FIG. 5. Neck 71 of a container is in close proximity to the cap. As shown in FIG. 9A the cap includes a pair of diametrically opposed openings 72 below each of which is formed stub 74. The lateral ends of the stubs may be cut away as shown at 73 in FIG. 9B; although this is not absolutely necessary it permits the stubs to displace more easily.

The underside of each stub has a ramp 75 designed to interact with a similar ramp 77 on projection 76 on the container. Container 71 also includes a pair of restraining ribs 79 which, by restraining stub 74, prevent rotation of the cap when assembled on the container.

To assemble a trigger sprayer having cap 70 to container 71, a pump module 49 (FIG. 5) including tubular extension 32, ferrule 36, gasket 39, and dip tube 51 is inserted into the mouth of the container, which has previously been filled with product The mouth of the container is then aligned with the cap of the trigger module (including U-shaped frame 1, handle 9, delivery arm 22 with nozzle and swirl plug, and side plate 12) so that the stubs of the cap are aligned with ribs 79. The cap and container are then laterally advanced relative to each other until ramps 77 and 75 mutually engage. Further advancement of the cap causes the ramps 77 to deform stubs 74 outward at ends 73 so that projections 76 and stubs 74 pass over one another. When the stubs have cleared the projections, they snap back into their original form due to plastic memory. The interaction of ledges **74*a* with associated ledges 76*a* prevents separation of the cap and the container and locks the two together. Additionally, ribs 79** act to prevent rotation of the cap relative to the container.

It should be apparent that only one set of ramps is required for this assembly to function. The ramps may be on the cap or on the container, or one ramp may be formed on each the cap and the container to limit assembly to a particular orientation. Also, one of the ribs in the pair of ribs 79 may be omitted to permit a consumer to rotate and remove the cap to refill the container.

Although a specific embodiment of the invention has been described in detail, it should be understood that the description is for purposes of understanding the invention. For example, although the invention has been described with the pump located completely within the container, the pump may also be located on top of the container.

Figure 1:
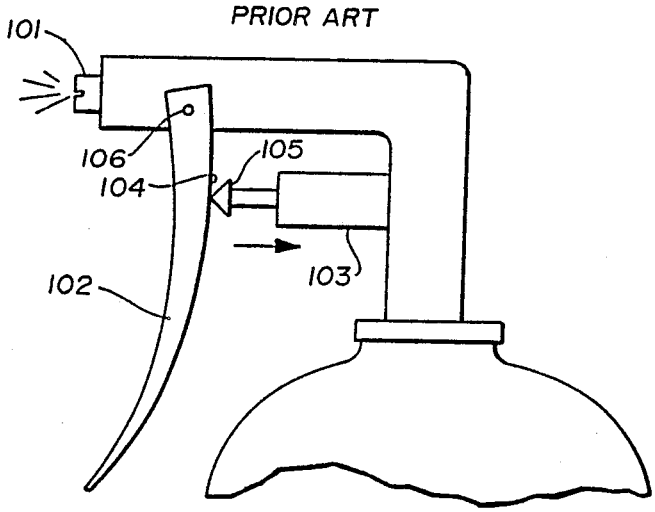
FIG. 1 PRIOR ART
FIGS. 1, 2 and 3 are schematic representations of conventional trigger sprayers.
Figure 2:
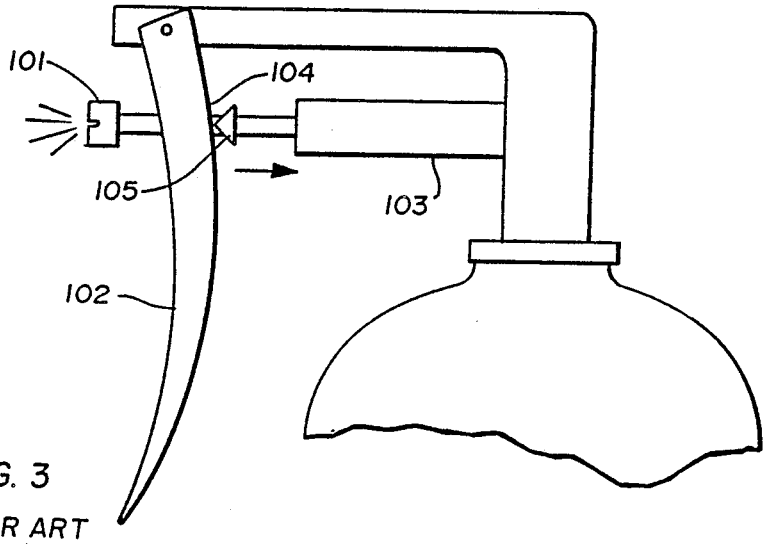
FIG. 2 PRIOR ART
Figure 3:
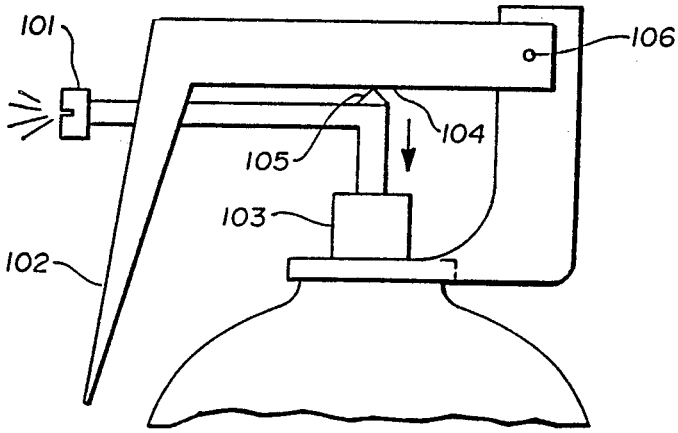
FIG. 3 PRIOR ART
Figure 10:
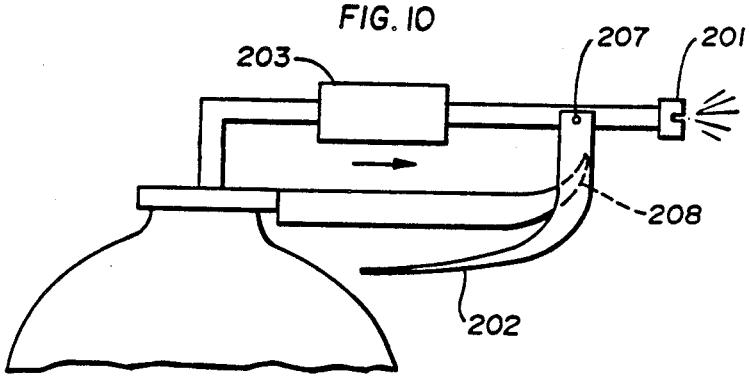
FIG. 10 is a schematic representation of an alternate embodiment of the present invention.

It should also be recognized that the structures shown in FIGS. 1, 2 and 3 can be modified to come within the scope of this invention by incorporating a flexure to mount trigger handle 102 or by incorporating sealing lip structures within pump 103. Finally, the relative orientation between the tubular extension and the delivery arm should not be limited to right angles as shown in the preferred embodiment; indeed, any orientation and direction of spray is contemplated. Moreover, the relative arrangement of the piston within the cylinder of the pump may be reversed, so that the trigger handle operates the pump by drawing the piston up from the cylinder rather than depressing a piston into the cylinder. Such an embodiment is illustrated schematically in FIG. 10, which depicts a trigger sprayer adapted for under hand, horizontal delivery. Operation of trigger handle 202 draws a piston within pump 203 to the right, thereby pumping liquid to nozzle 201. During operation of the trigger handle, flexure 208 distorts to eliminate any change in radial distance from pivot point 207. Pump 203 may incorporate sealing lip structures to prevent leakage when the trigger sprayer is not operated.

Further modifications of these embodiments may, of course, be made by those skilled in the art without departing from the scope of the invention which is set forth in the following claims.

What is claimed is:

1. A method for assembling a trigger sprayer which includes a container for holding a product, a pump module for pumping the product, and a pump actuating module for actuating the pump, said method comprising the steps of:

adding the product to the container;

placing the pump module into the container; and relatively advancing the pump actuating module and the container holding the pump module so that locking means locks the container, the pump module and the pump actuating module together, and so that mating means join complementary portions of the pump module and the pump actuating module, thereby to allow operation of the trigger sprayer.

2. A method according to claim 1, wherein the locking means includes a displaceable member mutually engageable with a projection, and said advancing step is performed only in a lateral direction bringing the pump actuating module and the container holding the pump module directly together and causes the projection initially to displace the displaceable member and then to allow the displaceable member to engage with the projection, thereby to lock the container to the pump actuating module.

3. A method according to claim 1, wherein the mating means includes a tubular extension extending from the pump module and a complementary tubular section in the pump actuating module, and said advancing step includes the step of inserting the tubular extension into the tubular section.

4. A method according to claim 1, wherein the container includes a neck having a portion of the locking means, and the pump actuating module includes a cap adapted to fit with the neck and having another portion of the locking means, and said method further comprises the step of aligning the neck with the cap prior to said advancing step.

* * * * *